US009546649B2

(12) United States Patent
Braun

(10) Patent No.: US 9,546,649 B2
(45) Date of Patent: Jan. 17, 2017

(54) CONCRETE PUMP WITH DISTRIBUTING BOOM

(71) Applicant: Putzmeister Engineering GmbH, Aichtal (DE)

(72) Inventor: Matthias Braun, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 14/651,703

(22) PCT Filed: Dec. 20, 2013

(86) PCT No.: PCT/EP2013/077587
§ 371 (c)(1),
(2) Date: Jun. 12, 2015

(87) PCT Pub. No.: WO2014/102169
PCT Pub. Date: Jul. 3, 2014

(65) Prior Publication Data

US 2015/0316043 A1 Nov. 5, 2015

(30) Foreign Application Priority Data

Dec. 28, 2012 (DE) ..... 10 2012 224 529

(51) Int. Cl.
*E04G 21/04* (2006.01)
*F04B 39/00* (2006.01)

(52) U.S. Cl.
CPC ..... *F04B 39/00* (2013.01); *E04G 21/04* (2013.01); *E04G 21/0418* (2013.01);
(Continued)

(58) Field of Classification Search
CPC ..... F04B 39/00; E04G 21/04; E04G 21/0427; E04G 21/0436; E04G 21/0445; E04G 21/0418
(Continued)

(56) References Cited

U.S. PATENT DOCUMENTS 6,675,822 B1 1/2004 Schmitz et al.
6,698,451 B2 * 3/2004 Anderson et al. ..... B66C 23/64 137/615
(Continued)

FOREIGN PATENT DOCUMENTS

DE 92 12 417 U1 1/1993
DE 196 08 549 A1 9/1997
(Continued)

OTHER PUBLICATIONS

International Search Report of PCT/EP2013/077587, mailed Mar. 28, 2014.
(Continued)

*Primary Examiner* — Kevin Lee
(74) *Attorney, Agent, or Firm* — Collard & Roe, P.C.

(57) ABSTRACT

A work device has a stationary or movable frame which has a substructure fixed to the frame, a rotating head rotatable about a vertical rotational axis on a bearing block of the substructure by a drive mechanism, and an extension arm mounted on a bearing point of the rotating head in a pivotal manner about a horizontal pivot axis. A hydraulic cylinder piston unit has ends fixed to the cylinder and to the piston rod and hinged to hinge points on the extension-arm side and on the rotating-head side with a horizontal hinge axis. The rotating head has a base section arranged on the bearing block and an adapter piece including the bearing point for the extension arm and the hinge point on the rotating-head side for the cylinder piston unit. The base section and the
(Continued)

Figure 1A:
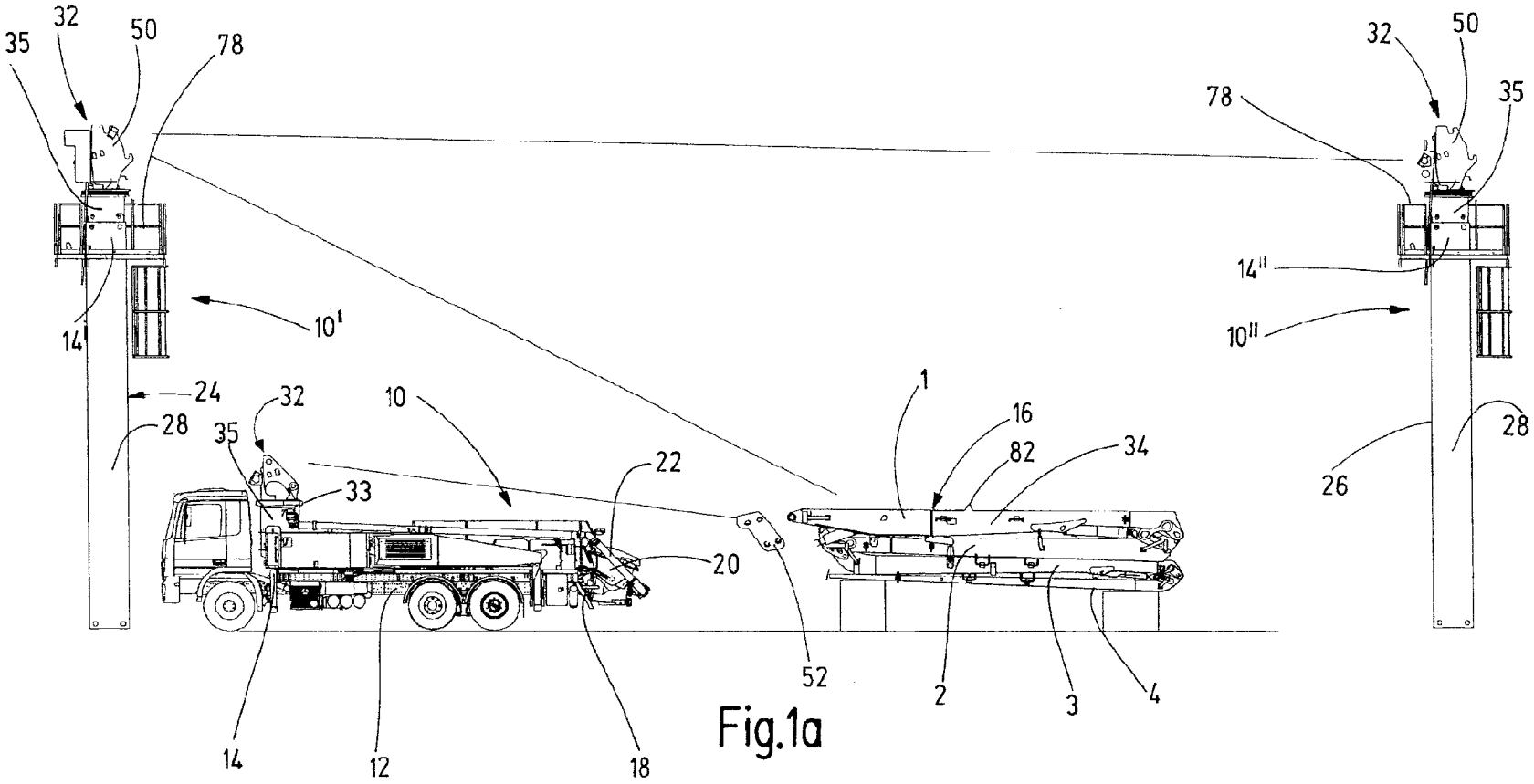

adapter piece can be removably coupled to each other via a separating point.

16 Claims, 15 Drawing Sheets

(52) U.S. Cl.
CPC ..... *E04G 21/0427* (2013.01); *E04G 21/0436* (2013.01); *E04G 21/0445* (2013.01)

(58) Field of Classification Search
USPC ..... 137/615
See application file for complete search history.

(56) References Cited

U.S. PATENT DOCUMENTS 7,654,286 B2 * 2/2010 Fuegel ..... E04G 21/04 137/615
9,062,465 B2 * 6/2015 Neubert et al. ..... E04G 21/0418

FOREIGN PATENT DOCUMENTS

| | | | |
|---|---|---|---|
| DE | 10 2005 026 120 | A1 | 12/2006 |
| EP | 1 235 965 | B1 | 9/2004 |
| JP | S60-47162 | A | 3/1985 |
| JP | 2008-202232 | A | 9/2008 |

OTHER PUBLICATIONS

German Search Report dated Mar. 6, 2013 in German Application No. 10 2012 224 529.4 with English translation of relevant parts.

* cited by examiner

CONCRETE PUMP WITH DISTRIBUTING BOOM

CROSS REFERENCE TO RELATED APPLICATIONS

This application is the National Stage of PCT/EP2013/077587 filed on Dec. 20, 2013, which claims priority under 35 U.S.C. §119 of German Application No. 10 2012 224 529.4 filed on Dec. 28, 2012, the disclosures of which are incorporated by reference. The international application under PCT article 21(2) was not published in English.

The invention relates to a concrete pump having a stationary or mobile frame with a sub-structure which is fixed to the frame, having a rotating head which is mounted on a bearing block of the sub-structure so as to be rotatable by means of a drive mechanism about a vertical axis, having an outrigger which is configured as a concrete distributing boom and supports a conveying line and which is articulated on a bearing point of the rotating head so as to have a horizontal pivot axis, and having a hydraulic cylinder-and-piston unit which by way of its ends which are fixed to the cylinder and to the piston rod, respectively, is articulated in each case on one outrigger-side and rotating head-side articulation point which is disposed so as to be spaced apart from the bearing point and has in each case a horizontal articulation axis. The conveying line by way of a supply pipe which is fixed to the sub-structure and a connection pipe which penetrates centrally through the rotating head is impingeable with liquid concrete, which connection pipe on its one end by way of a rotating joint which is coaxial in relation to the vertical rotation axis of the rotating head is connected to the supply pipe and by way of a rotating joint which is coaxial in relation to the horizontal pivot axis of the outrigger connected to the outrigger-side conveying line.

Known concrete pumps of this type have a distributing boom as an outrigger which carries a concrete-conveying line which is connected to the pressure connector of a core pump which is disposed so as to be fixed to the frame. The drive mechanism for the rotating head usually has a drive pinion which is rigidly connected to the bearing block. During assembly, the bearing block with its drive pinion is initially inserted into the drive mechanism in the sub-structure and then screwed to the sub-structure. Much care is required here in order for the gears of the drive pinion not to be damaged in the process. Therefore, assembly is most often performed ex works. On the other hand, many construction sites cannot be served by mobile concrete pumps due to a lack of space. Stationary sub-structures onto which the outrigger which is configured as a distributing boom is placed are required there. It would thus be advantageous if the distributing boom could be readily removed from a mobile concrete pump and assembled on a stationary boom. Such a distributing boom for concrete pumps, having the features stated at the outset, is known per se (EP 1 235 965 B1). The components which belong to the drive mechanism of the bearing block there are integrated in the sub-structure, such that replacing the outrigger is readily possible. This is achieved in that a drive pinion of the sub-structure carries an alignment pin which projects coaxially beyond the sub-structure and at least one rotary entrainment element which is eccentrically disposed, while the bearing block has a receptacle bush which is complementary to the alignment pin and is releasably placeable thereon, and at least one entrainment part which is releasably coupleable to the rotary entrainment element. The separation point between the sub-structure and the outrigger is thus located between the sub-structure and the bearing block, such that the rather heavy bearing block is a component part of the outrigger which has to be removed from the sub-structure during the replacement operation.

Proceeding therefrom, the invention is based on the object of improving the concrete pump of the type mentioned at the outset in that the separation point between the sub-structure and the distributing boom is simplified.

In order to achieve this object, the combination of features according to the invention is proposed. Advantageous design embodiments and refinements of the invention are discussed below.

The achievement according to the invention is above all based on the concept of making the alignment pin of the known assembly dispensable by moving the separation point into the region of the rotating head. According to the invention this is achieved in that the rotating head has a base part which is disposed on the bearing block and an adaptor piece which comprises the bearing point for the outrigger and the rotating head-side articulation point for the cylinder and piston unit, in that the base part and the adaptor piece are releasably intercoupled by way of a separation point, and in that the connection pipe is subdivided into a first part-pipe which is connected to the base part and connected to the supply pipe and a second part-pipe which is connected to the adaptor piece and connected to the outrigger-side conveying line, wherein the first and the second part-pipes by way of a pipe coupling are releasably intercoupleable in the region of the separation point.

One preferred design embodiment of the invention provides that the base part and the adaptor piece on their separation point have at least two coupling elements which in pairs are interconnectable in a form-fitting manner. In this way it is possible that in the region of the separation point the outrigger together with the adaptor piece can be separated from the base part of the rotating head, while during the separation operation the base part together with the bearing block and the drive mechanism remains on the sub-structure which is fixed to the frame.

One preferred design embodiment of the invention provides that in each case a first group of coupling elements are configured as drop-in elements and a second group of coupling elements are configured as receptacles for the drop-in elements. Advantageously, the adaptor piece here is provided with two drop-in elements or drop-in element pairs, and the base part is provided with two receptacles or receptacle pairs which are open toward the top of the periphery and which in each case at least in the vertical direction are mutually spaced apart. In this way, the outrigger with the adaptor piece can be dropped into the receptacles of the base part by means of a crane. In the case of a suitable disposal of the drop-in elements and receptacles, this may expediently be performed by a simple vertical lowering movement of the outrigger by the crane. A combined horizontal and vertical movement of the outrigger by the crane during the drop-in operation would also be conceivable. In the opposite direction, the outrigger may be lifted by the crane from the base part of the rotating head.

In order for the drop-in operation to be facilitated, it has proven advantageous for the lower of the two receptacles or receptacle pairs to be connected to the front periphery of the upper receptacle by way of a stop face which adjoins the rear face of said two receptacles or receptacle pairs and which preferably points obliquely upward. In this case, when the outrigger is guided in from the side and lowered, the lower drop-in element initially stops on the stop face, such that the drop-in elements are automatically guided into their receptacles from above when the outrigger is further lowered. It is particularly advantageous for the upper receptacle to have a steeper front face than the lower receptacle. If the front face of the lower receptacle forms a circular segment of which the center is located in the base region of the upper receptacle, dropping-in the lower drop-in element is possible even when the upper drop-in element has already ingressed into its upper receptacle.

A further improvement in this respect is achieved according to an advantageous design embodiment of the invention when the two upper and lower receptacles which are laterally spaced apart from one another have in each case one external run-in face and one internal support face for the drop-in elements, and when the support faces at their lowermost points have latching troughs for latching of the drop-in elements in the coupled state of the adaptor piece and the base part. In this way it is achieved that during the drop-in operation initially the upper drop-in element runs onto the external run-in face of the upper receptacle and into the latching trough which is located in the support face once the outrigger is lowered, and that thereafter the second drop-in element with a certain degree of play ingresses via the external run-in face into the lower receptacle, so as to latch into the latching trough of the support face of the lower receptacle while forming a form-fitting connection, when the outrigger is further lowered. On account of the torque arising from gravity, the form-fitting coupling of the drop-in elements and the associated receptacles is sufficient in order to retain the outrigger with its adaptor piece in the latching troughs of the base part. In this state, the crane gear which is engaged on the outrigger for transport may be released, so that the crane may be assigned to a further transport task. However, it is expedient for safety reasons that in addition to the form-fitting connection in the region of the separation point a safety connection, for example by means of an insert or latch pin, is also established between the adaptor piece and the base part. This may be completed by a fitter working from a platform which is fixed to the sub-structure.

One further advantageous design embodiment of the invention provides that the adaptor piece has two side panels which are spaced apart at a defined spacing and the intermediate space of which is bridged by at least one drop-in element which is configured as a drop-in pin, whereas the base part has at least one receptacle, which is open toward the top of the periphery, for the drop-in pin. In order for the adaptor piece to be readily placed onto the base part, the base part in the region of the receptacles expediently has a width which is smaller than or equal to the available width between the side panels of the adaptor piece. Moreover, the adaptor piece in the region of the lower edge of its side panels, and/or the base part in the region of its upper edge may have run-up ramps which facilitate converging of the adaptor piece and the base part.

One modified variant of the embodiment provides that the adaptor piece has at least two drop-in elements which are configured as drop-in pins and which in pairs protrude in a mirror-symmetrical manner toward opposite sides on the side panels, while the base part on two side walls which are spaced apart from one another has, in each case, at least one receptacle, which is open toward the top of the periphery, for the drop-in pins. In this case, the adaptor piece in the region of the pins expediently has a width which is smaller than or equal to the available width between the side walls of the base part. In addition, the base part in the region of the upper edge of its side walls, and/or the adaptor piece in the region of the lower edge of its side panels should have run-up ramps which facilitate converging of the adaptor piece and the base part.

One further advantageous constructive design embodiment of the invention may be for the side panels of the adaptor piece to be kept apart from one another by at least one web which bridges the intermediate space.

Figure 1B:
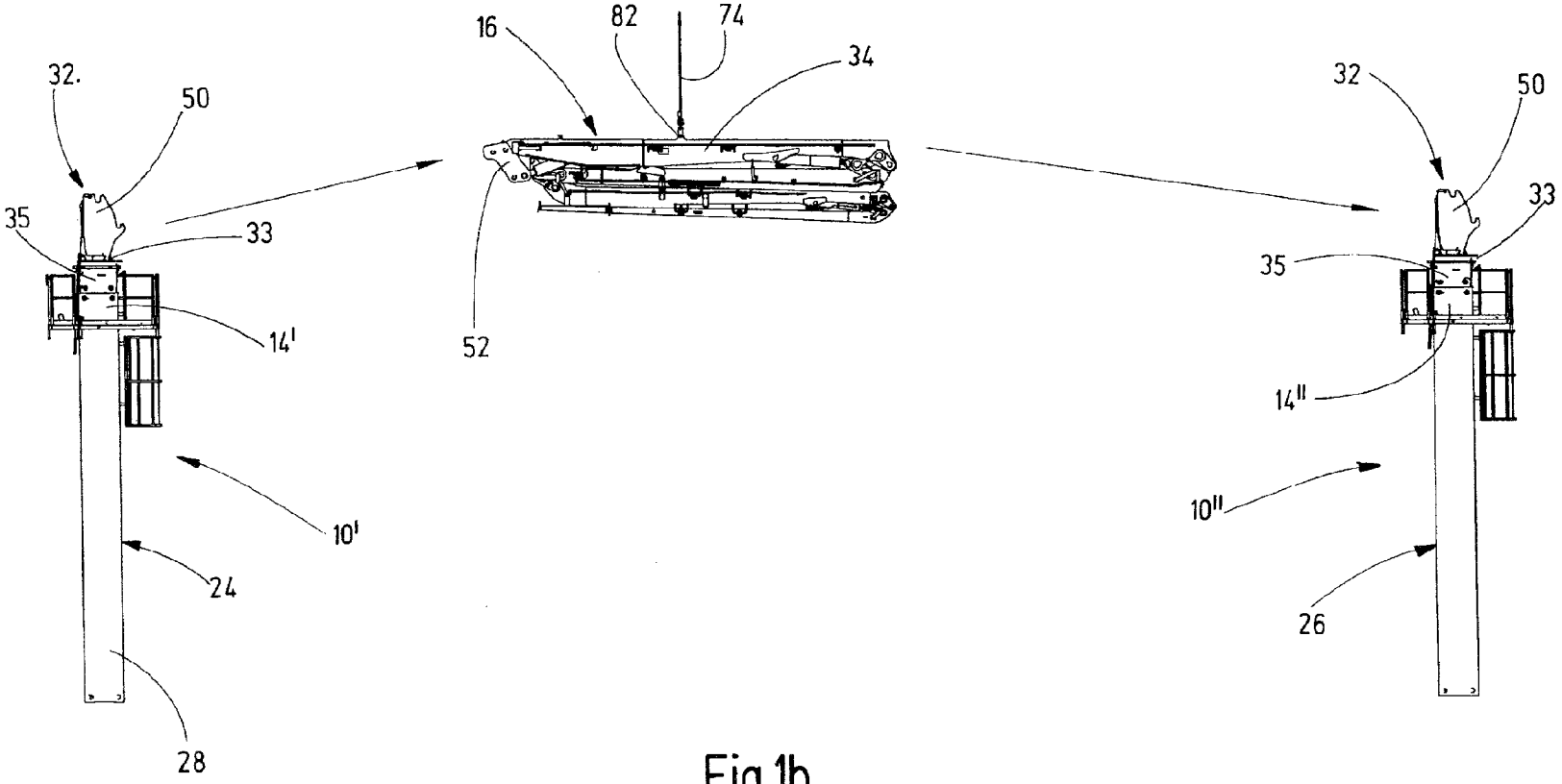
Figure 2A:
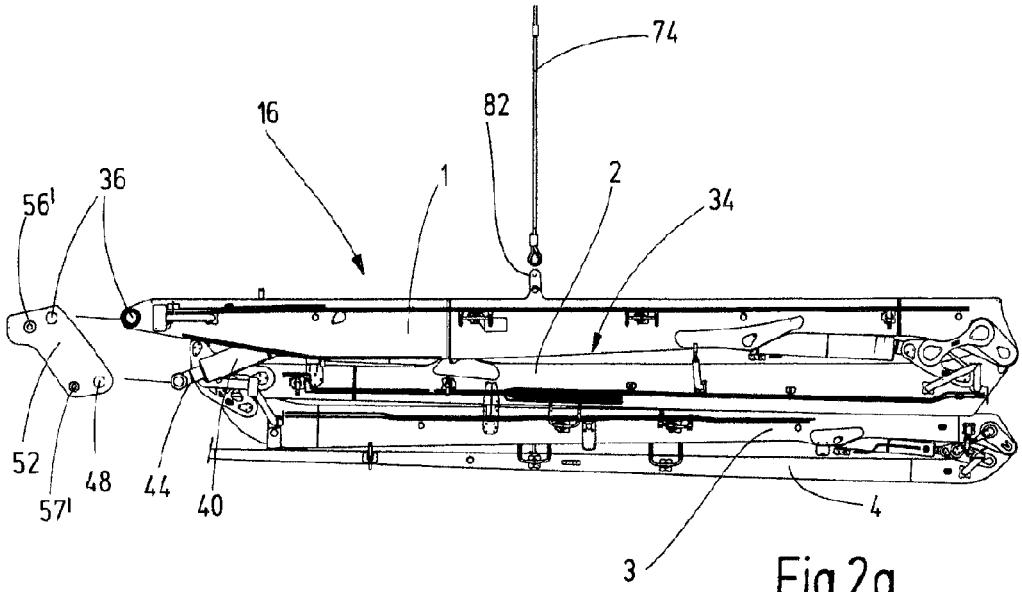

In the following the invention will be explained in more detail by means of the exemplary embodiments which are schematically illustrated in the drawing in which:

FIG. 1*a* shows a side view of a mobile and of two stationary sub-structures for an outrigger which is configured as an arm pack of a distributing boom;

FIG. 1*b* shows an illustration corresponding to FIG. 1*a*, without a mobile sub-structure, in order to visualize a repositioning operation for the outrigger;

FIG. 2*a* shows an enlarged detail from FIG. 1*a;*

Figure 2B:
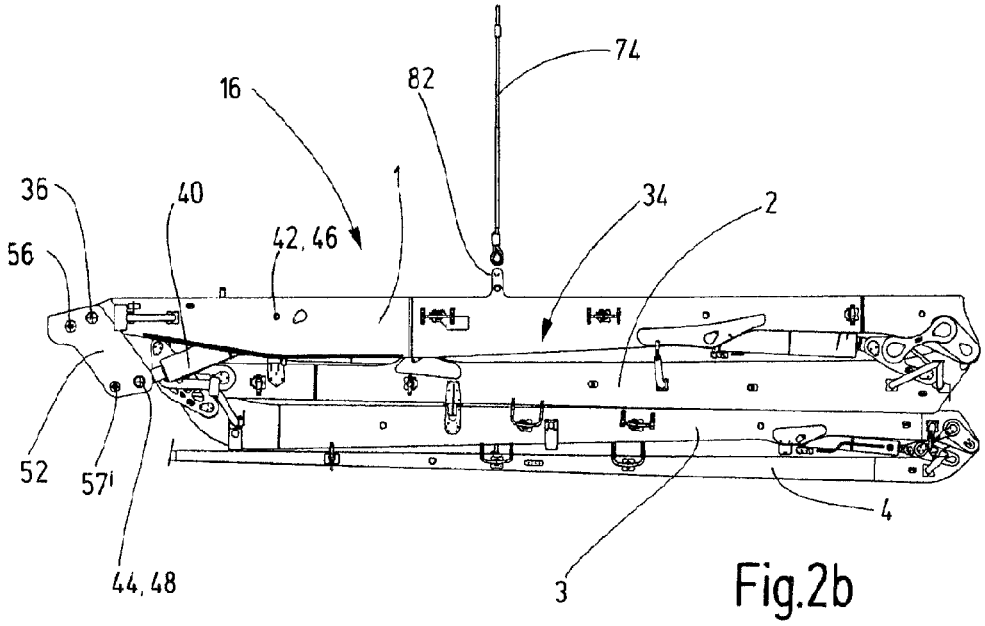

FIG. 2*b* shows an enlarged detail from FIG. 1*b;*

Figure 3A:
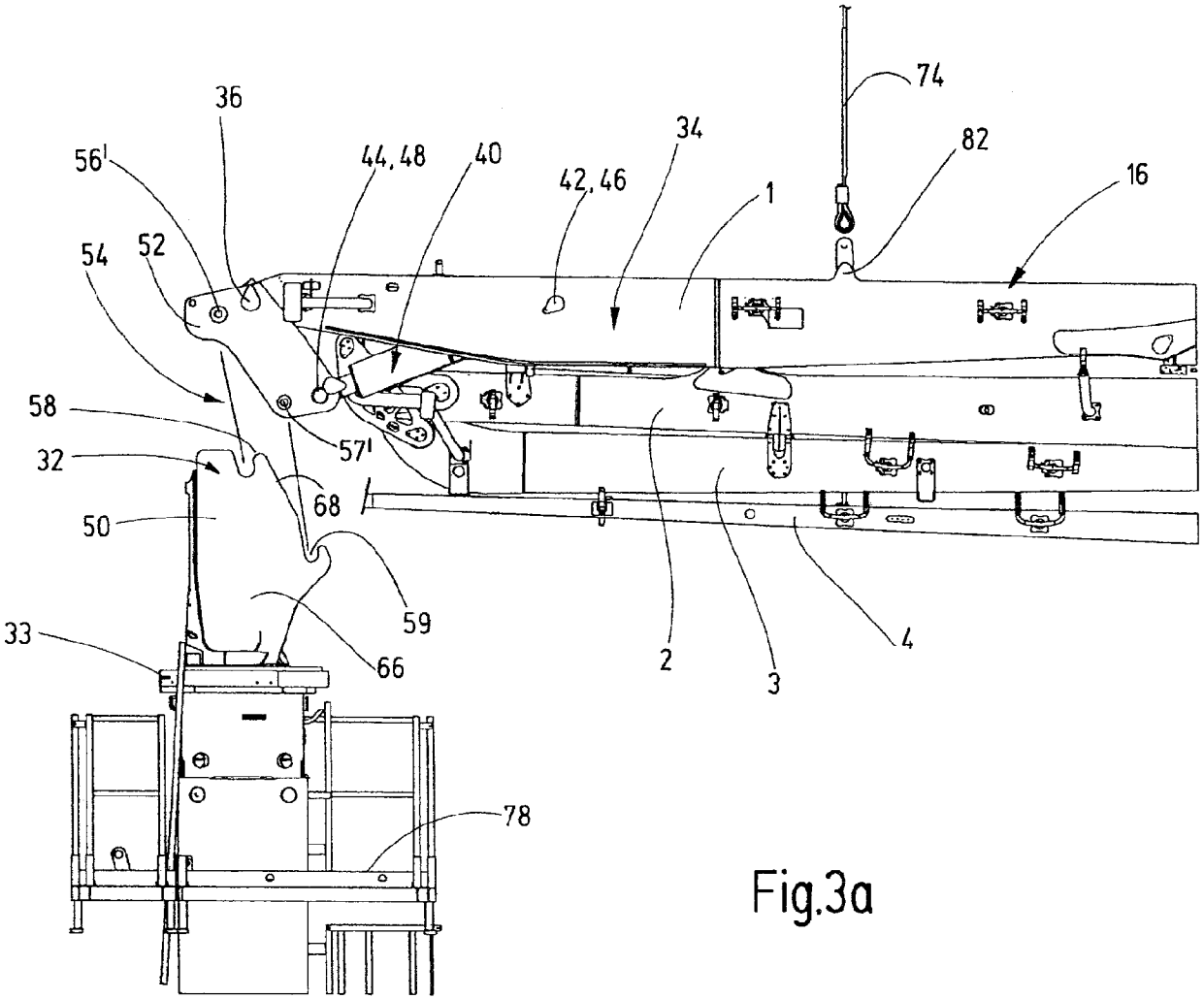
Figure 3B:
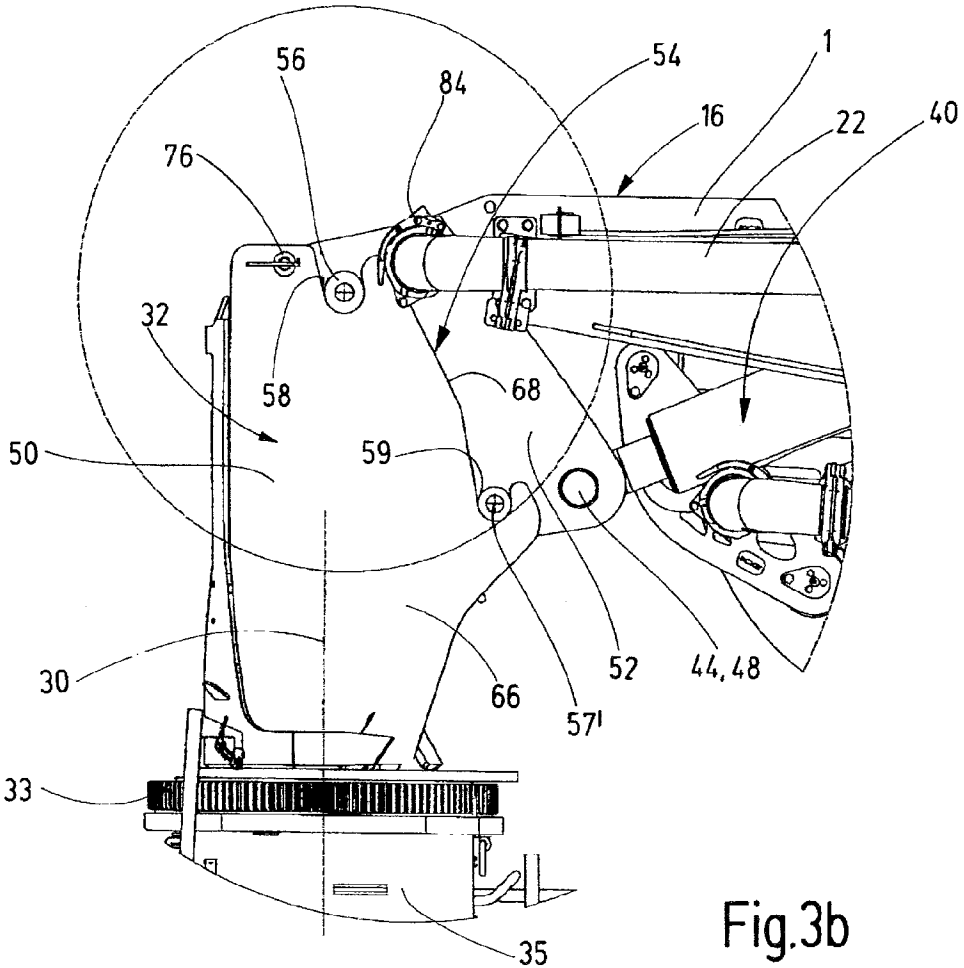
Figure 3C:
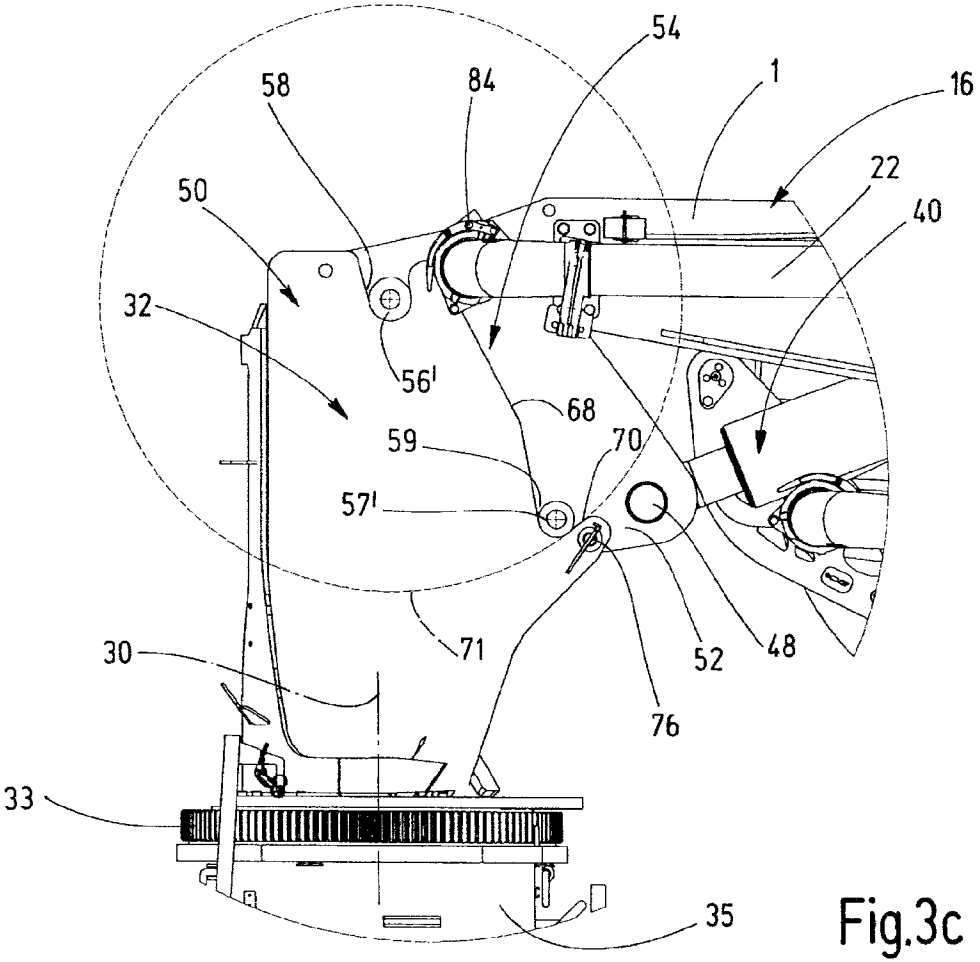
Figure 4B:
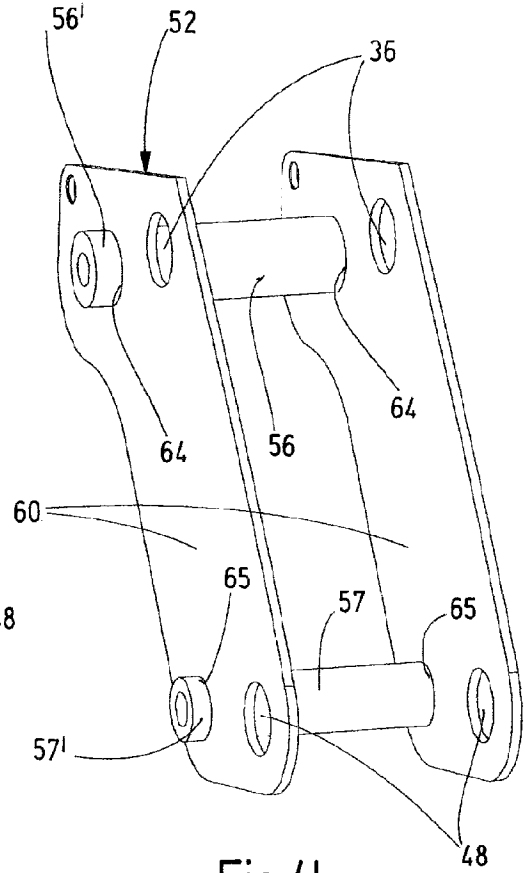
Figure 4A:
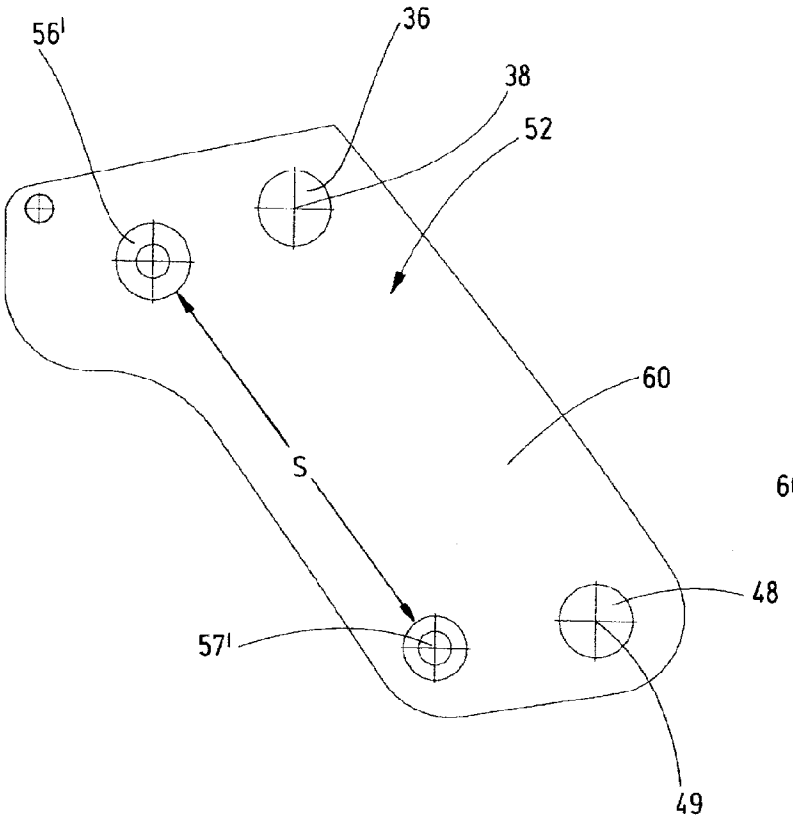

FIG. 3*a* shows a side view of the arm pack and of a stationary sub-structure, in order to visualize the drop-in operation;

FIG. 3*b* shows an illustration corresponding to FIG. 3*a*, in an enlarged illustration, with the arm pack assembled on the sub-structure;

FIG. 3*c* shows an illustration corresponding to FIG. 3*b*, for a modified exemplary embodiment;

FIGS. 4*a* and *b* show a side view and a diagrammatic illustration of the adaptor piece for the arm pack as per FIGS. 3*a* to *c;*

Figure 5A:
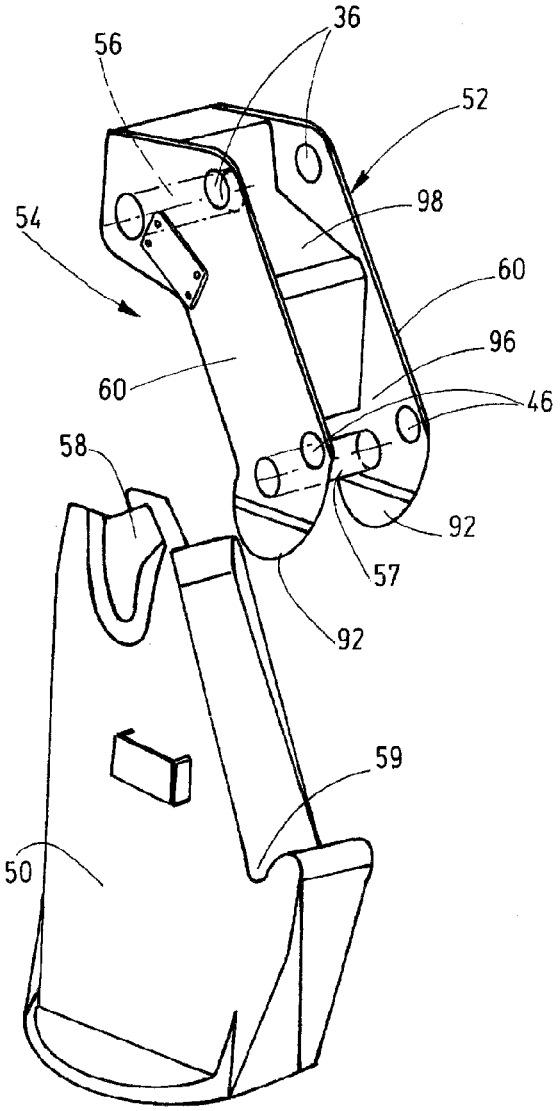
Figure 5B:
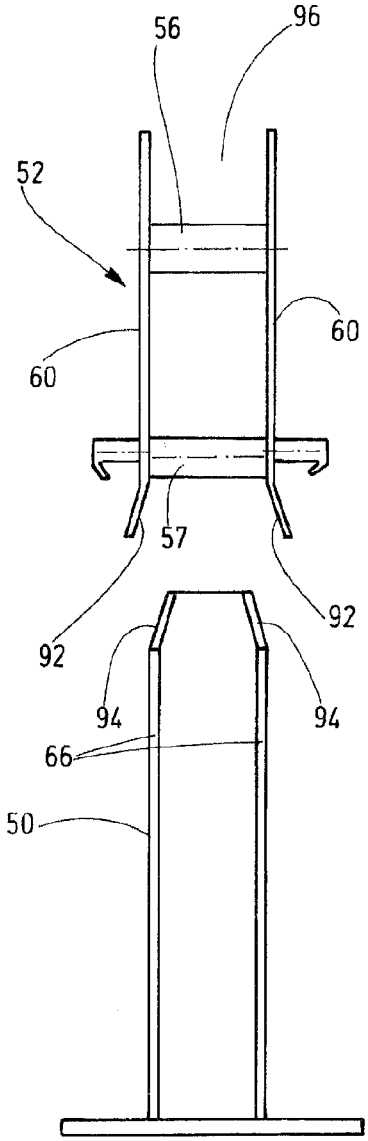
Figure 5C:
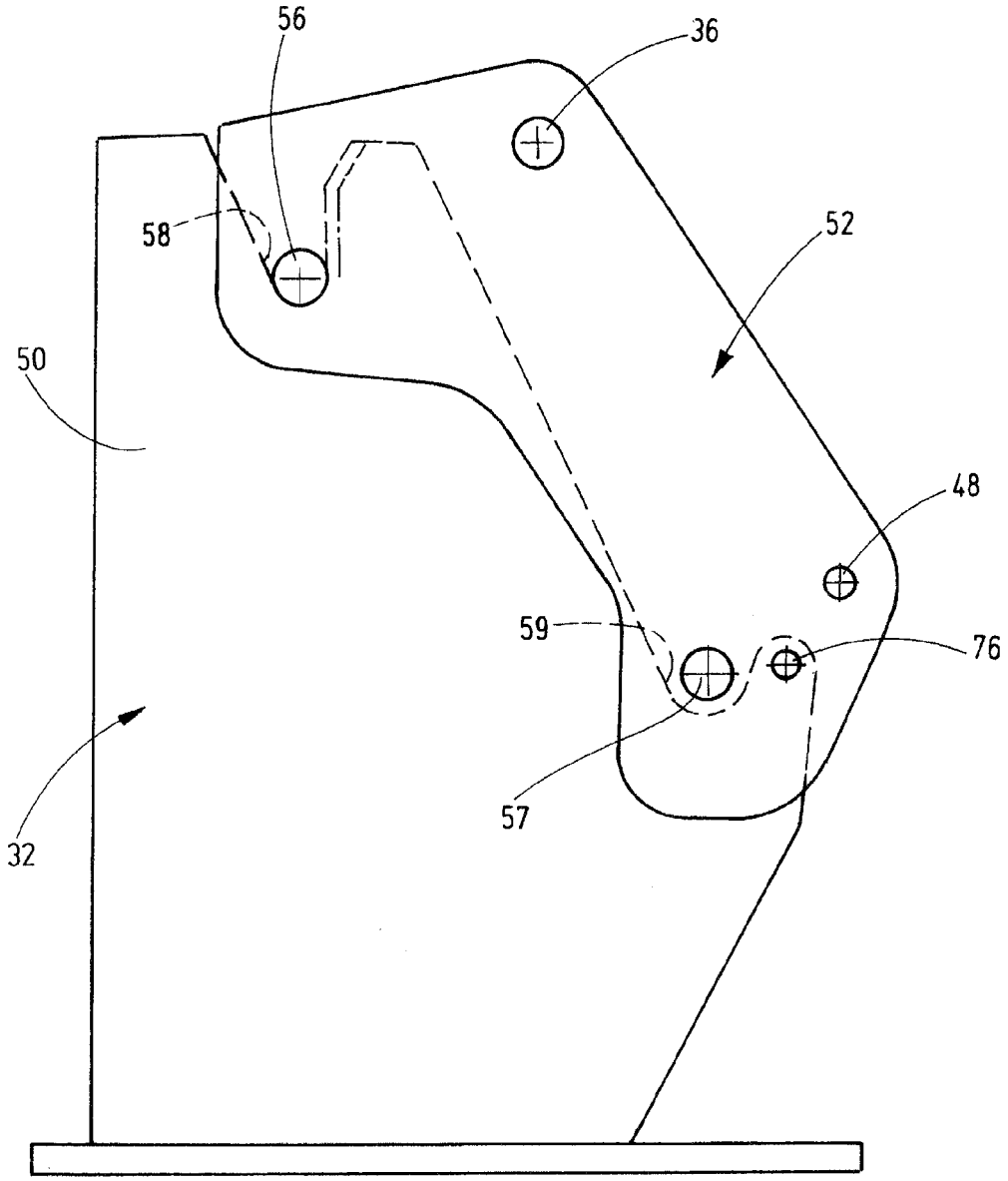
Figure 6:
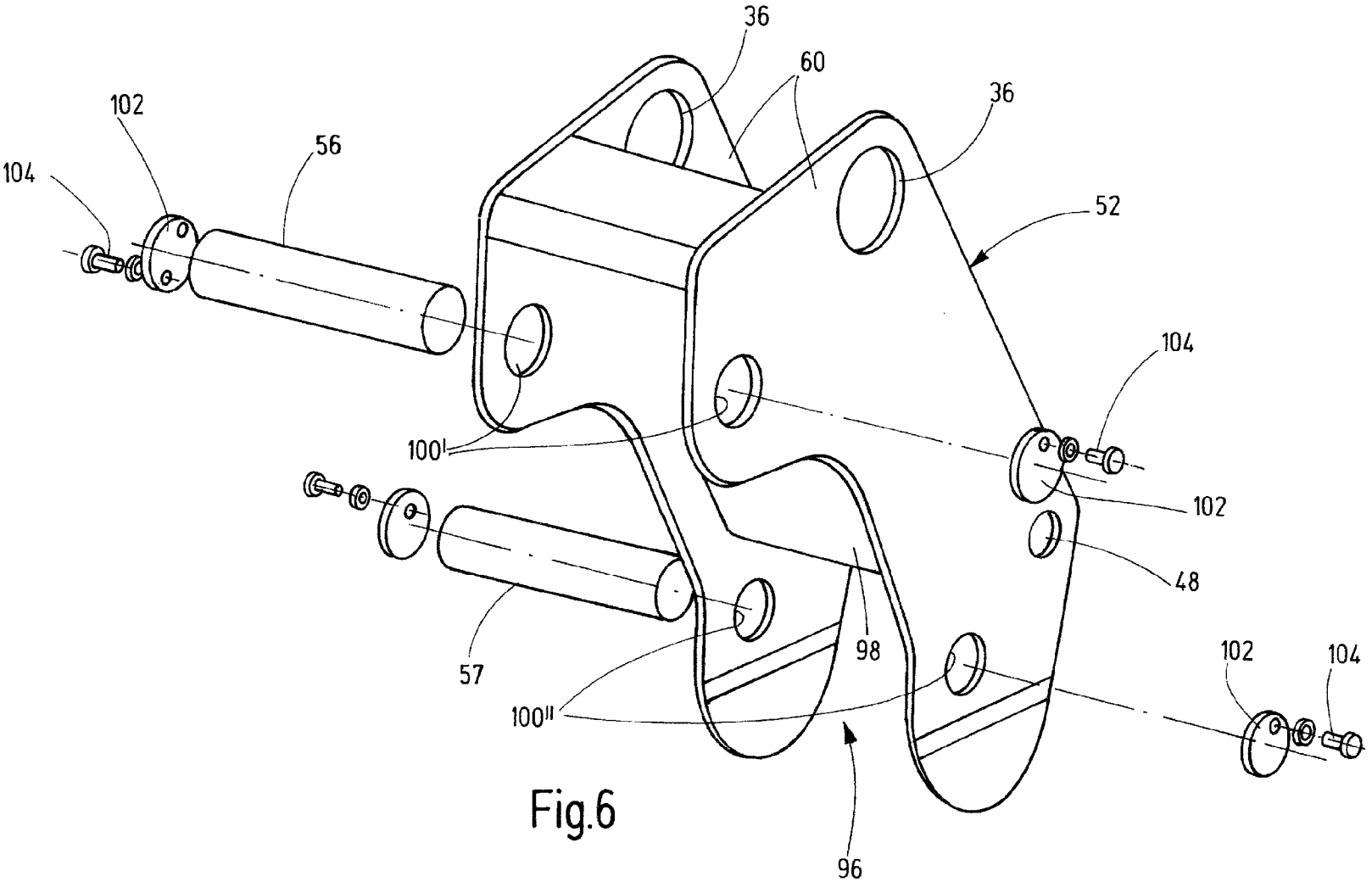

FIGS. 5*a* and *b* show a modified exemplary embodiment of a rotating head having a base part and an adaptor piece, in a diagrammatic exploded illustration and in a side view;

FIG. 5*c* shows a further side view of the rotating head as per FIGS. 5*a* and *b*, in the assembled state;

FIG. 6 shows a diagrammatic exploded illustration of the adaptor piece as per FIGS. 5*a* to *c;*

Figure 7A:
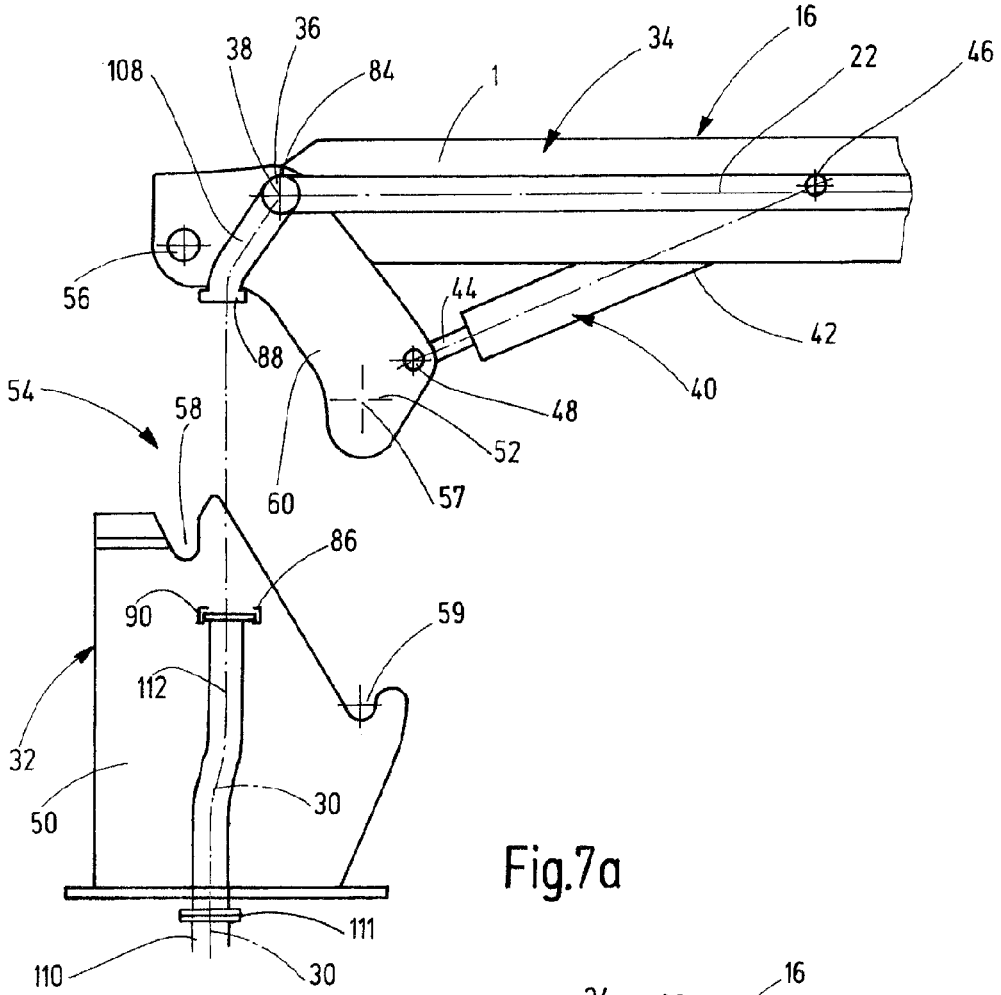
Figure 7B:
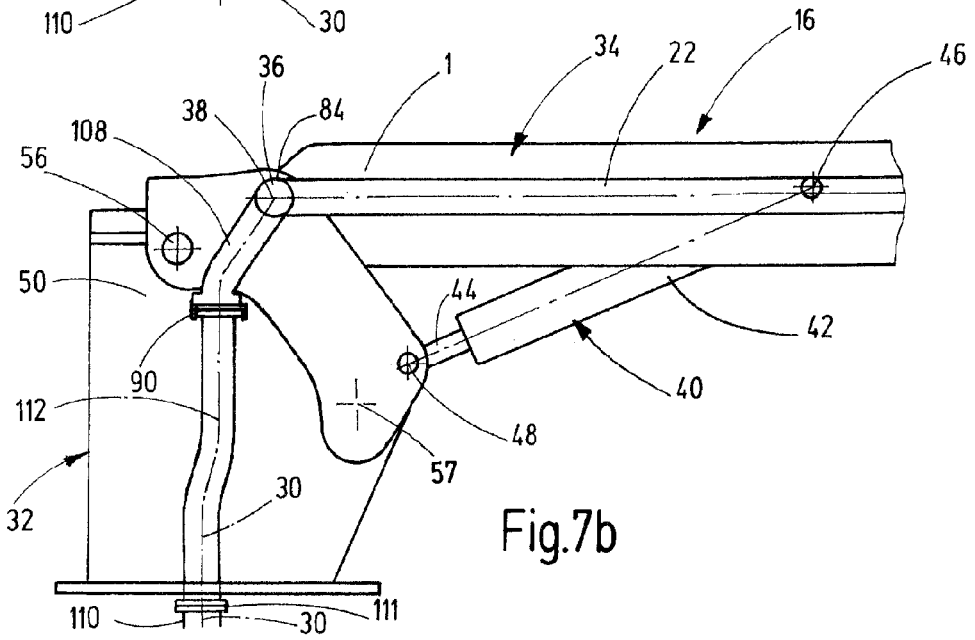
Figure 8A:
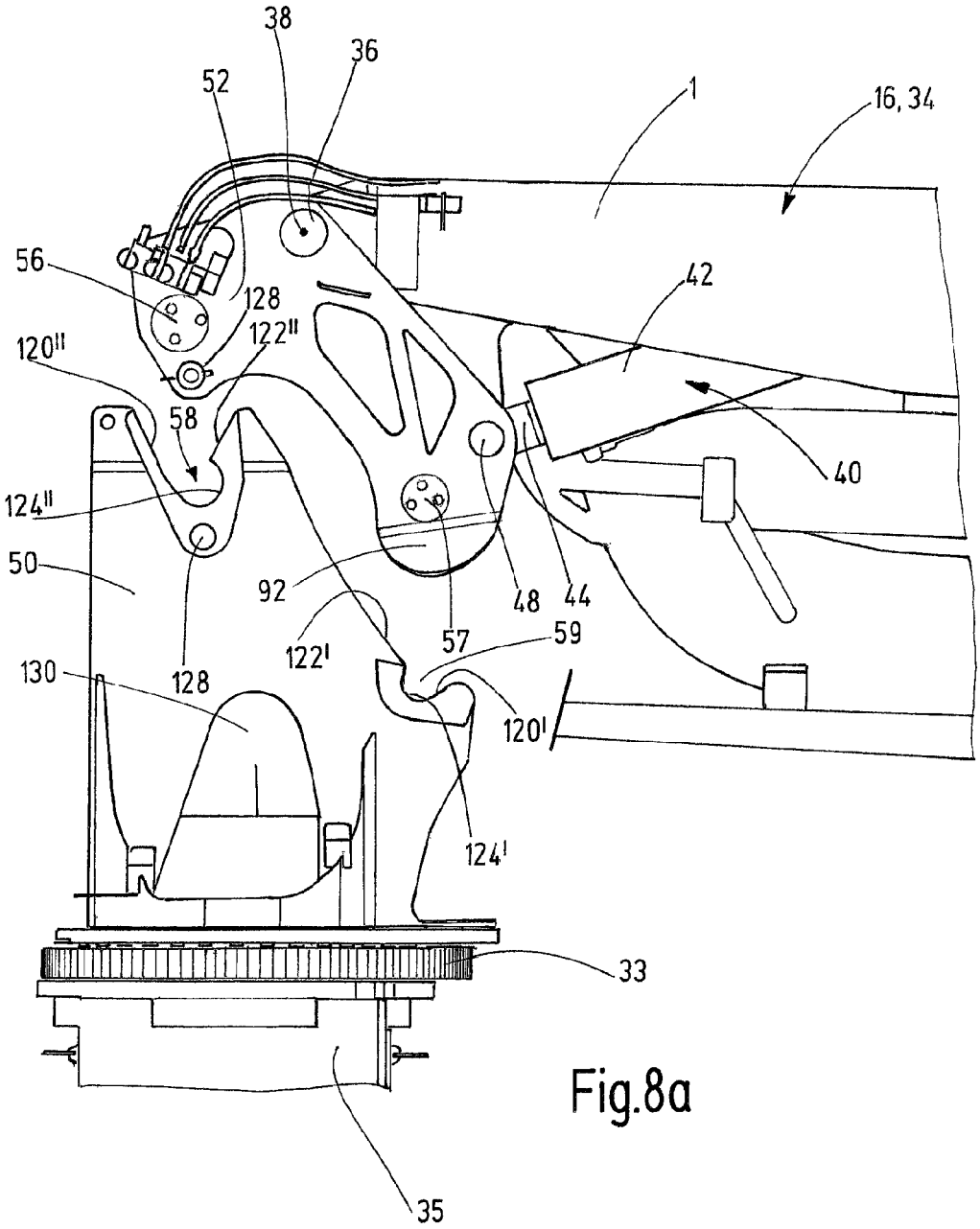
Figure 8B:
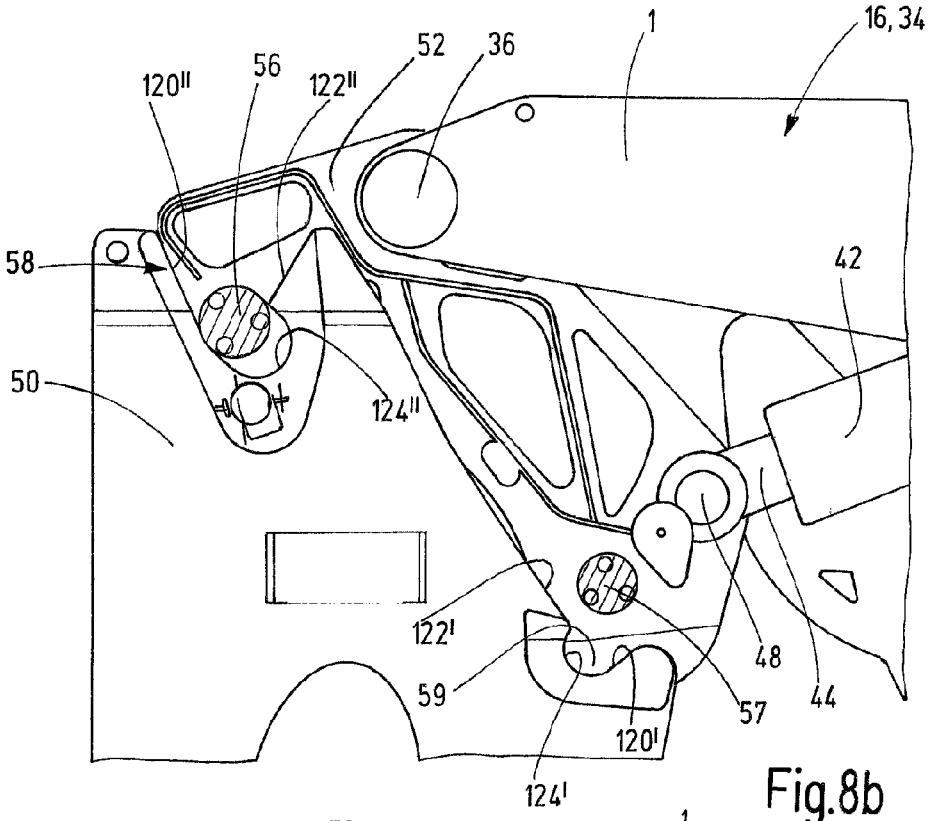
Figure 8C:
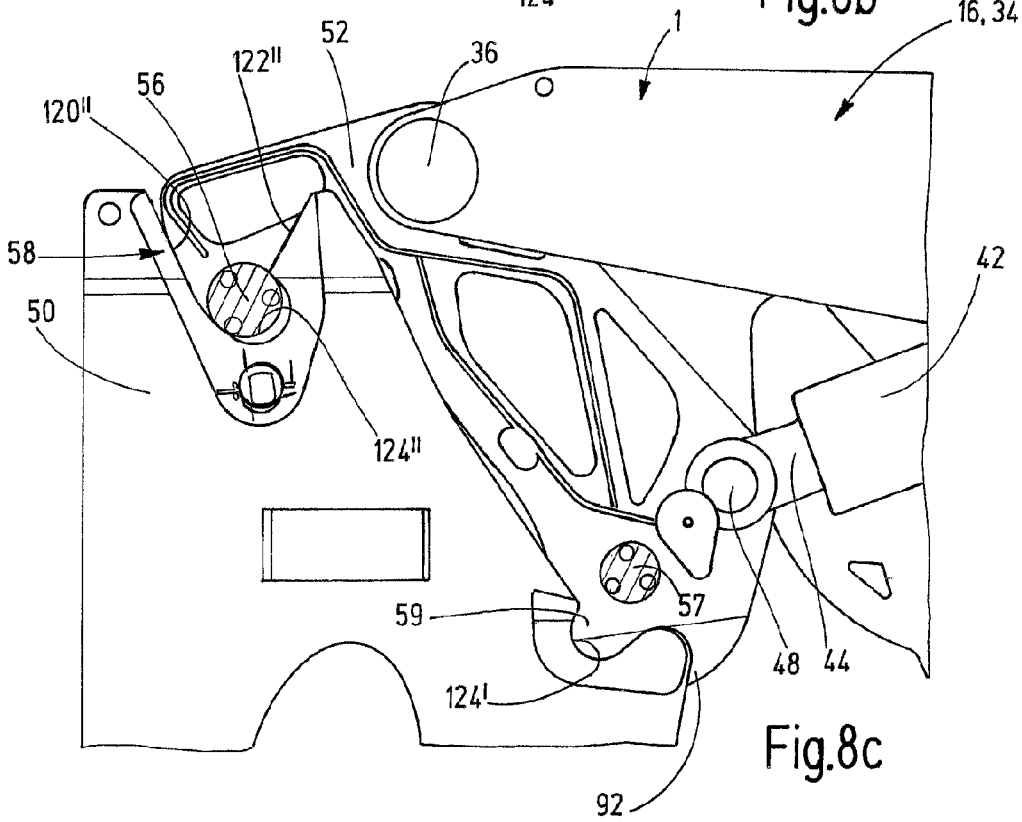
Figure 8D:
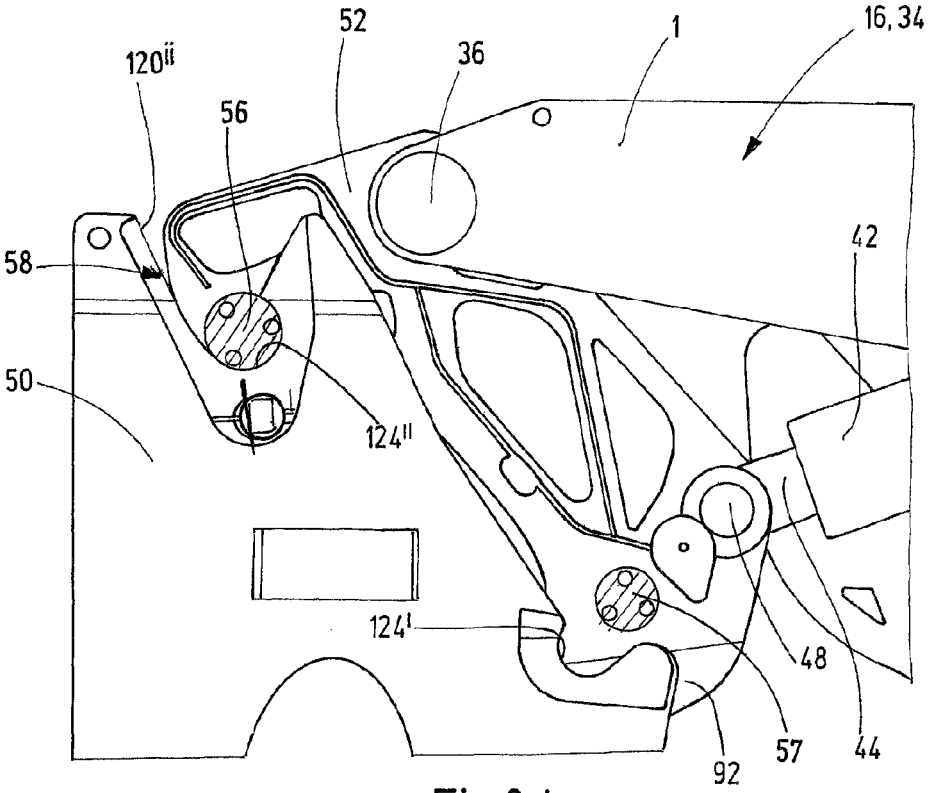
Figure 8E:
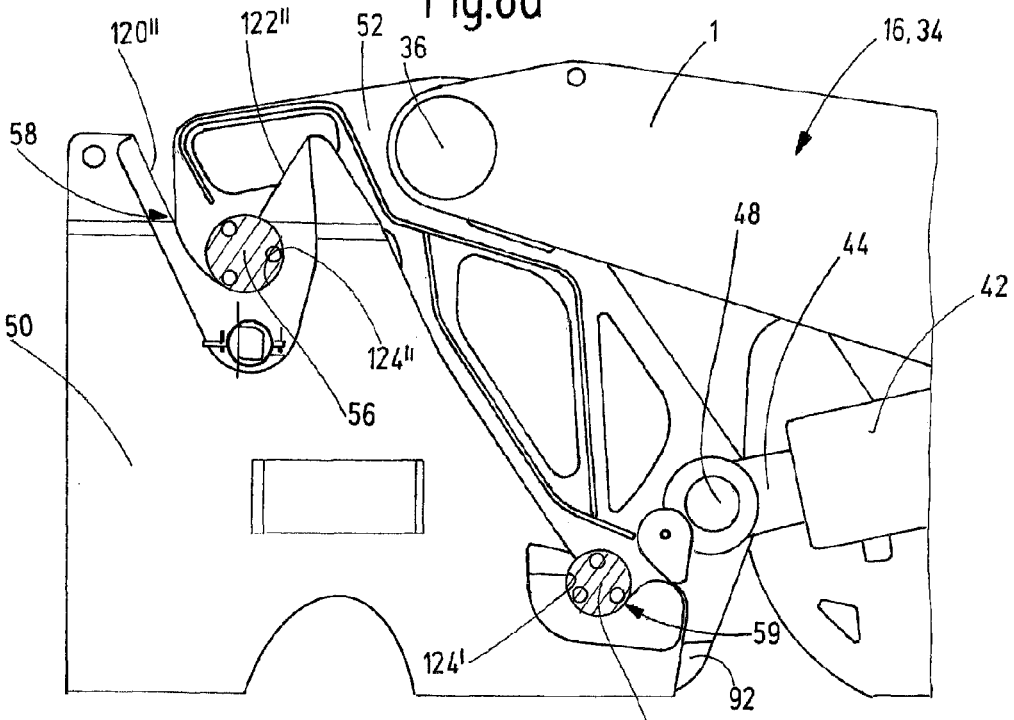
Figure 8F:
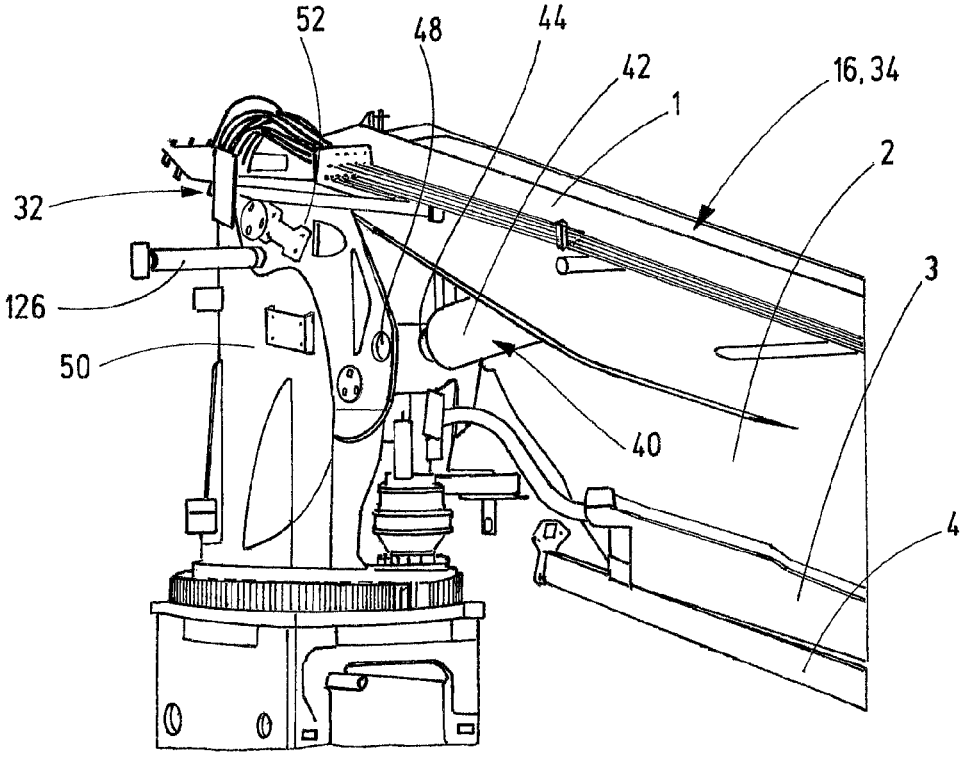

FIGS. 7*a* and *b* show a side view of the rotating head with the arm pack and the conveying line, in the separated and in the assembled state;

FIG. 8*a* shows a further exemplary embodiment of a rotating head with the arm pack, in the separated state;

FIGS. 8*b* to *e* show an enlarged detail from FIG. 8*a*, in various assembly states during the drop-in phase;

FIGS. 8*f* and *g* show the exemplary embodiment as per FIGS. 8*a* to *e*, in the assembled state with the extended and retracted safety pin.

The working equipment illustrated in the drawing is configured as a concrete pump having a mobile or stationary frame 10, 10', 10". The mobile concrete pump which is shown in the left region of FIG. 1*a* has a sub-structure 14, which is disposed on a road chassis 12, for receiving an outrigger 16 which is configured as a distributing boom. A core pump 18 having a material supply container 20 is assembled on the road chassis 12, the outflow connector of which core pump 18 is connected via a supply pipe 110 to a concrete conveying line 22 which is routed across the distributing boom. The stationary booms 24, 26 which are additionally illustrated in FIG. 1, have a stationary frame 10', 10" which is configured as a pipe column 28, which on its upper part supports the respective sub-structure 14' 14" for the outrigger 16.

The sub-structure 14, 14', 14" in all variants of embodiments additionally has a rotating head 32 which is rotatable about a vertical rotation axis 30, the drive mechanism 33 of which rotating head 32 is integrated in a bearing block 35 of the sub-structure 14, 14', 14".

The arm pack 34 which forms the outrigger 16 has a plurality of boom arms 1, 2, 3, 4 which are pivotable in pairs counter to one another and which support the concrete conveying line 22. As can be seen in particular from FIGS. 3*a* and *b*, the outrigger 16 with its first boom arm 1 in the assembled state is mounted on a bearing point 36 of the rotating head 32 so as to be pivotable about a horizontal pivot axis 38. In order for the outrigger 16 to be able to be pivoted in relation to the rotating head 32, a hydraulic cylinder-and-piston unit 40 which configured as a dual-action hydro cylinder and which by way of its end 42 which is fixed on the cylinder and its end 44 which is fixed on the piston rod is articulated on, in each case, an outrigger-side articulation point 46 which is disposed so as to be spaced apart from the bearing point 36 and a rotating head-side articulation point 48 having a horizontal articulation axis 49 is moreover provided.

A particularity of the invention lies in that the rotating head 32 has a base part 50 which is disposed on the bearing block 35, and an adaptor piece 52 which comprises the bearing point 36 for the outrigger 16 and the rotating head-side articulation point 48 for the cylinder-and-piston unit 40. The base part 50 and the adaptor piece 52 are releasably intercoupleable by way of a separation point 54. For this purpose, the adaptor piece 52 has two pin-shaped drop-in elements 56', 57' which in pairs are directed toward opposite sides, while the base part 50 has two receptacles 58, 59 for the drop-in elements 56', 57', which are in each case present in pairs and are open toward the top of the periphery and at least in the vertical direction are spaced apart from one another by the spacing s. As can be seen from FIGS. 4*a* and 4*b*, the adaptor piece 52 is composed of two side panels 60 and two spacer pins 56, 57 which keep the side panels 60 spaced apart from one another at a predefined spacing, wherein the spacer pins 56, 57 by way of their free pin ends engage outward through clearances 64, 65 in the side panels 60, while forming the pin-shaped drop-in elements 56', 57'. The bores shown in FIGS. 4*a* and 4*b* form the bearing point 36 for the outrigger 16 and the rotating head-side articulation point 48 for the cylinder-and-piston unit 40.

The base part 50 has two side walls 66 which are disposed so as to be spaced apart from one another and in which the receptacles 58, 59 which are open toward the top of the periphery are disposed. The in each case uppermost of the two receptacles 58 is connected to the rear face of the lower receptacle 59 by way of a stop face 68 which adjoins the front periphery of said receptacle in an obliquely downward manner. In this way, when the outrigger 16 is guided in from the side and lowered in the context of FIG. 3*a*, the lower drop-in elements 57' initially stop on the stop face 68, such that the drop-in elements 56', 57' are automatically guided into the receptacles 58, 59 from above when the outrigger 16 is further lowered. If, as is illustrated in FIG. 3*c*, the front face 70 of the lower receptacle 59 forms a segment of a circular arc 71 of which the center is located in the bottom region of the upper receptacle 58, guiding the lower drop-in element 57' into the receptacle 59 is possible even when the upper drop-in element 56' has already ingressed into its upper receptacle 58.

The form-fitting coupling of the drop-in elements 56', 57' and the associated receptacles 58, 59, as is shown in FIGS. 3*b* and 3*c*, is already sufficient in order to retain the outrigger 16 with its adaptor piece 52 under the influence of gravity in the base part 50 of the rotating head 32. In this state, the crane gear 74, which is engaged on the outrigger 16 for transport, may be released from the outrigger 16. On account thereof, the relevant crane may be freed up for a further transport task. As can be seen from FIGS. 3*b* and 3*c*, in addition to the form-fitting connection in the region of the separation point 54 a safety connection, which in the case of FIG. 3*b* is established in the upper region and in the case of FIG. 3*c* is established in the lower region by means of an insert or latch pin 76 between the adaptor piece 52 and the base part 50, is also provided. This may be retrofitted by a fitter working from a platform 78 (cf. FIG. 3*a*) which is fixed to the sub-structure.

As can be seen from FIG. 1*a*, the described construction enables repositioning an outrigger 16 which is configured as an arm pack 34 between various stationary and mobile frames 10, 10', 10" using simple means. The adaptor piece 52 is not required for assembly on the road chassis 12. In this case, the arm pack 34 may be immediately attached to the pre-assembled rotating head 32, without the adaptor piece 52. However, the adaptor piece 52 substantially facilitates the assembly of the arm pack 34 on the stationary column-shaped frames 10, 10", the sub-structure 14' 14" of which is populated with a pre-assembled base part 50 of the rotating head having the features described above. For this purpose, the adaptor piece 32 is pre-assembled on the arm pack 34 in the way shown in FIGS. 2*a* and 2*b*. Transporting to the stationary frames 10', 10" is then performed with the aid of a crane (not illustrated) which is fixed to the outrigger 16 at the position of the center of gravity 82 thereof by way of a cable or a crane gear 74. Conveying pipes 22 for liquid concrete, the rotating joints 84 of which are already pre-assembled (FIGS. 3*b* and *c*), are to be found both in the sub-structure 14', 14", as well as on the outrigger 16. In the process of assembling the outrigger 16 on the rotating head 32, only one pipe connection between a pipe end 86 which is fixed to the sub-structure and a pipe end 88 which is fixed to the outrigger has to be produced using a pipe connector 90 (FIGS. 7*a, b*).

A further exemplary embodiment of a rotating head 32 having an adaptor piece 52 is illustrated in FIGS. 5*a* to 7*b*, which exemplary embodiment differs from the exemplary embodiment as per FIGS. 1 to 4, as previously described, in the following features:

As can be seen in particular from FIGS. 5*a, b*, and 6, the adaptor piece 52 has two side panels 60 which are spaced apart at a defined spacing and the intermediate space of which is bridged by two drop-in elements 56, 57 which are configured as drop-in pins, whereas the base part has two receptacles 58, 59, which are open toward the top of the periphery, for the drop-in pins 56, 57. In order for the adaptor piece 52 to be readily placed onto the base part 50, the base part 50 in the region of the receptacles 58, 59 has a width which is smaller than or equal to the available width between the side panels 60 of the adaptor piece 52. Moreover, the adaptor piece 52 in the region of the lower edge of its side panels has run-up ramps 92 for the base part 50, while the base part 50 in the region of its upper edge has run-up ramps 94 for the adaptor piece 52. The run-up ramps 92, 94 facilitate converging of the adaptor piece 52 and the base part 50. A further peculiarity of this exemplary embodiment lies in that the side panels 60 of the adaptor piece 52 are kept apart from one another by at least one web 98 which bridges the intermediate space 96. As can be seen from FIG. 6, the pin-shaped drop-in elements 56, 57 are pushed through bores 100', 100" in the side panels 60 and secured on the side panels 60 of the adaptor piece 52 by means of two head plates 102 and suitable screws 104. In principle, it is possible for the drop-in elements 56, 57 to be fixed to the side panels 60 in another way too, for example for them to be welded thereto.

It can be seen from FIGS. 7*a* and *b* that the upper bore in the side panels 60 is provided as the bearing point 36 for the arm pack 34, while the lower bore is provided as the rotating head-side articulation point for the piston-side end 44 of the cylinder-and-piston unit 40. In order for thick matter such as liquid concrete to be able to be conveyed, the outrigger 16 which is configured as the arm pack 34 supports a conveying line 22 which is routed across the boom arms 1, 2, 3, 4 of the distributing boom. The conveying line 22 is impingeable with liquid concrete by way of a supply pipe 110 which is fixed to the sub-structure and a connection pipe 108, 112, which penetrates centrally through the rotating head 32. On one end, the connection pipe is connected to the supply pipe 110 by way of a rotating joint 111 which is coaxial in relation to the vertical rotation axis 30 of the rotating head 32, and on the other end connected to the outrigger-side conveying line 22 by way of a rotating joint 84 which is coaxial in relation to the horizontal pivot axis 38 of the outrigger 52. The connection pipe itself is subdivided in the region of the separation point 54 into a first part-pipe 112 which is connected to the base part 50 and connected to the supply pipe 110 and a second part-pipe 108 which is connected to the outrigger-side conveying line 22, wherein the first part-pipe 112 and the second part-pipe 108 at their pipe ends 86, 88 are releasably intercoupleable by way of the pipe coupling 90. In order for the assembly operation to be facilitated, the part-pipes 108, 112 of the connection pipe in the region of their mutually facing pipe ends 86, 88 are axially and radially moveable in relation to one another when the pipe coupling 90 is released. Moreover, the pipe coupling 90 between the part-pipes 108, 112 is externally accessible going through a clearance 130 in the base part.

Figure 8G:
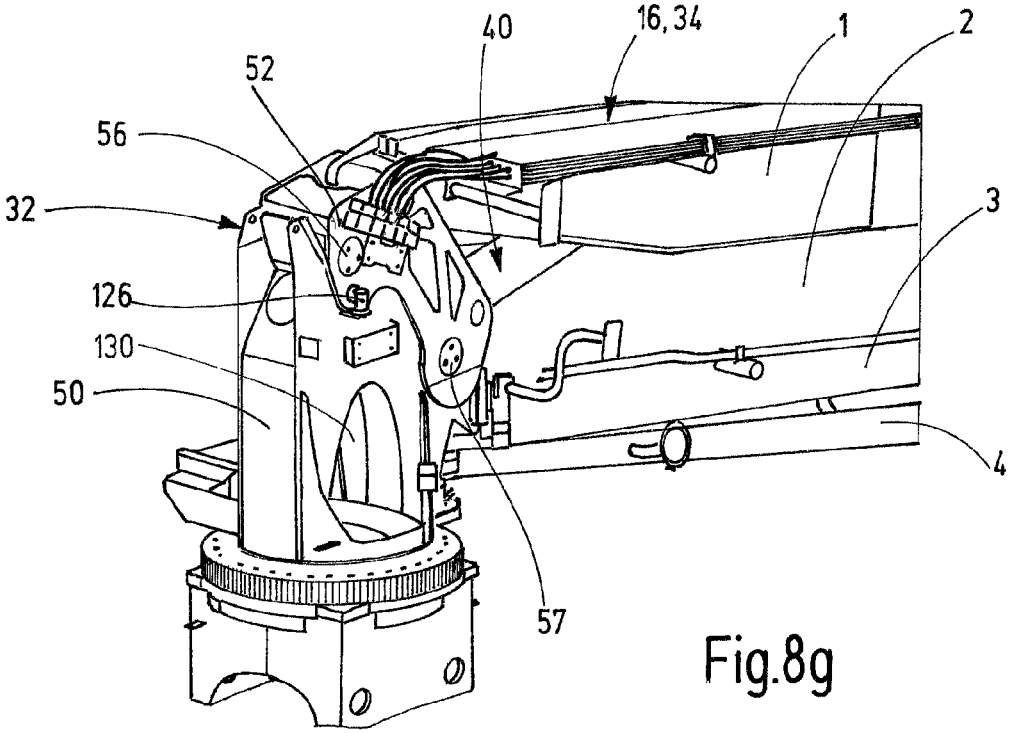

The exemplary embodiment shown in FIGS. 8*a* to *f* differs from the preceding embodiments above all in the geometric contour of the two receptacles 58, 59 in the base part 50. The two receptacles 58, 59 are disposed on the base part 50 so as to be laterally spaced apart from one another and at different heights. The two receptacles 58, 59 have in each case one external run-in face 120', 120" and one internal support face 122', 122" on the adaptor piece 52 for the drop-in elements 57, 56. A peculiarity lies in that the support faces in each case on their lowest points have latching troughs 124', 124" for latching the drop-in elements 57, 56 in the coupled state between the adaptor piece 52 and the base part 50. As can be seen from FIGS. 8*b* to *e*, in this disposal the following assembly sequence results: first, the upper drop-in element 56 on the adaptor piece 52 is introduced via the run-in face 120" into the upper receptacle 58, while the lower drop-in element 57 still remains outside the lower receptacle 59, the arm pack 34 being inclined in a slightly upward manner (FIGS. 8*b, c*). As soon as the upper drop-in element 56 reaches the bottom of the receptacle 58 and from there reaches the latching trough 124" of the support face 122", the arm pack 34 may be pivoted about the axis of the upper latching trough 124" in the direction of the base part 50, such that the lower drop-in element 57 impacts the lower run-in face 120' and via the latter reaches the stop against the respective latching trough 124' in the lower receptacle (FIGS. 8*d, e*). In the position which is shown in FIG. 8*e*, a form-fit results between the adaptor piece 52 and the base part 50, which form-fit, on account of the torque generated by gravity, holds the arm pack 34 in the latched position. In order for the arm pack 34 to be secured on the rotating head 32, only the adaptor piece 52 and the base part 50 are still secured using a socket pin 126. This socket pin 126 is illustrated in FIG. 8*f* in an extracted position and in FIG. 8*g* in an inserted position. The openings 128 for the socket pin 126 are disposed such that they are aligned with one another in the latched position of the drop-in elements 56, 57 and the socket pin may be displaced into its locking position. A further advantage of the variant of the embodiment shown in FIGS. 8*a* to *g* lies in that the cylinder-and-piston unit 40 may be in the retracted end position of the piston rod during the drop-in operation.

In summary, the following is to be stated: the invention relates to a working equipment having a stationary or mobile frame 10, 10', 10" which has a sub-structure 14, 14', 14" which is fixed to the frame, a rotating head 32 which by means of a drive mechanism 33 is rotatable about a vertical rotation axis 30 on a bearing block 35 of the sub-structure, and an outrigger 16. The outrigger 16 is mounted on a bearing point 36 of the rotating head 32 so as to be pivotable about a horizontal pivot axis 38. Furthermore, a hydraulic cylinder-and-piston unit 40, which by way of its end 42 which is fixed to the cylinder and its end 44 which is fixed to the piston rod is articulated on outrigger-side and rotating head-side articulation points 46, 48, having a horizontal articulation axis, is provided. A peculiarity of the invention lies therein that the rotating head 32 has a base part 50 which is disposed on the bearing block 35 and an adaptor piece 52 which comprises the bearing point 36 for the outrigger 16 and the rotating head-side articulation point 48 for the cylinder-and-piston unit 40. The base part 50 and the adaptor piece 52 are releasably intercoupleable by way of a separation point 54.

LIST OF REFERENCE SIGNS

1, 2, 3, 4 Boom arms
10, 10' 10" Frame
12 Road chassis
14', 14', 14" Sub-structure
16 Outrigger
18 Core pump
20 Material supply container
22 Concrete conveying line
24 Stationary boom
26 Stationary boom
28 Pipe column
30 Rotation axis
32 Rotating head
33 Drive mechanism
34 Arm pack
35 Bearing block
36 Bearing point
38 Pivot axis
40 Cylinder-and-piston unit
42 Cylinder-side end
44 Piston rod-side end
46 Outrigger-side articulation point
48 Rotating head-side articulation point
49 Horizontal articulation axis
50 Base part
52 Adaptor piece
54 Separation point
56, 56' Drop-in elements
57, 57' Drop-in elements
58, 59 Receptacles
60 Side panel
64, 65 Clearances
66 Side walls
68 Stop face
70 Front face
71 Circle

72 Center
74 Crane gear
76 Insert or latch pin
78 Platform
82 Position of center of gravity
84 Rotating joint
86 Pipe end fixed to sub-structure
88 Pipe end fixed to outrigger
90 Pipe connector
92 Run-up ramps
94 Run-up ramps
96 Intermediate space
98 Web
100' 100", Bores
102 Head plates
104 Screws
108 Part-pipe
110 Supply pipe
111 Rotating joint
112 Part-pipe
120', 120" Run-in faces
122', 122" Support faces
124', 124" Latching troughs
126 Socket pin
128 Openings
130 Clearance

The invention claimed is:

1. A concrete pump having a stationary or mobile frame with a sub-structure which is fixed to the frame, having a rotating head which is mounted on a bearing block of the sub-structure so as to be rotatable by means of a drive mechanism about a vertical rotation axis, having an outrigger which is configured as a concrete distributing boom and supports a conveying line and which is articulated on a bearing point of the rotating head so as to have a horizontal pivot axis, and having a hydraulic cylinder-and-piston unit which by way of sits ends which are fixed to a cylinder and to a piston rod, respectively, is articulated in each case on one outrigger-side and rotating head-side articulation point which is disposed so as to be spaced apart from the bearing point and has in each case a horizontal articulation axis, wherein the conveying line by way of a supply pipe which is fixed to the sub-structure and a connection pipe which penetrates centrally through the rotating head is impingeable with liquid concrete, said connection pipe on its one end by way of a rotating joint which is coaxial in relation to the vertical rotation axis of the rotating head is connected to the supply pipe and on its other end by way of a rotating joint which is coaxial in relation to the horizontal pivot axis of the outrigger is connected to an outrigger-side conveying line, wherein the rotating head has a base part which is disposed on a bearing block and an adaptor piece which comprises the bearing point for the outrigger and the rotating head-side articulation point for the cylinder and piston unit, wherein the base part and the adaptor piece are releasably intercoupled by way of a separation point, wherein the connection pipe is subdivided into a first part-pipe which is connected to the base part and connected to the supply pipe and a second part-pipe which is connected to the adaptor piece and connected to the outrigger-side conveying line, wherein the first and the second part-pipes by way of a pipe coupling are releasably intercoupled in the separation point, and wherein the base part and the adaptor piece on their separation point have coupling elements which in pairs are interconnectable in a form-fitting manner, wherein a first group of coupling elements are configured as drop-in elements and a second group of coupling elements are configured as receptacles for the drop-in elements, and wherein the adaptor piece is provided with two drop-in elements or drop-in element pairs, and the base part is provided with two receptacles or receptacle pairs which are open toward a top of a periphery and which in each case at least in a vertical direction are mutually spaced apart.

2. The concrete pump as claimed in claim 1, wherein the adaptor piece has two side panels which are spaced apart at a defined spacing and an intermediate space of which is bridged by said one drop-in element which is configured as a drop-in pin, and wherein the base part has aid one receptacle, which is open toward the top of a periphery, for the drop-in element.

3. The concrete pump as claimed in claim 2, wherein the base part in the receptacles has a width which is smaller than or equal to an available width between side walls of the adaptor piece.

4. The concrete pump as claimed in claim 2, wherein the adaptor piece in a lower edge of side panels, and/or the base part in an upper edge have/has run-up ramps which facilitate converging of the adaptor piece and the base part.

5. The concrete pump as claimed in claim 1, wherein the adaptor piece has at least two pin-shaped drop-in elements which in pairs protrude in a mirror-symmetrical manner toward opposite sides on side panels, and wherein the base part on two side walls which are spaced apart from one another has, in each case, at least one receptacle, which is open toward a top of a periphery, for the drop-in elements.

6. The concrete pump as claimed in claim 5, wherein side panels of the adaptor piece in the drop-in elements have a mutual spacing which is smaller than or equal to an available width between the side walls of the base part.

7. The concrete pump as claimed in claim 5, wherein the base part in an upper edge of side walls, and/or the adaptor piece in a lower edge have/has run-up ramps which facilitate converging of the adaptor piece and the base part.

8. The concrete pump as claimed in claim 1, wherein the in each case upper of the two receptacles or receptacle pairs is connected to a rear face of a lower receptacle or a lower receptacle pair by way of a stop face which adjoins a front periphery of said receptacles or receptacle pairs in an obliquely downward manner.

9. The concrete pump as claimed in claim 1, wherein in each case an upper receptacle has a steeper front face than a lower receptacle.

10. The concrete pump as claimed in claim 9, wherein a front face of a lower receptacle forms a circular segment of which a center is located in a base region of an upper receptacle.

11. The concrete pump as claimed in claim 1, wherein the base part and the adaptor piece in an assembled state are additionally coupled by means of a safety member so as to be secured against the drop-in elements being lifted out of the receptacles.

12. The concrete pump as claimed in claim 2, wherein side panels of the adaptor piece are kept apart from one another by at least one web which bridges an intermediate space.

13. The concrete pump as claimed in claim 1, wherein the receptacles have in each case one external run-in face and one internal support face for the drop-in elements, and wherein support faces at their lowermost points have latching troughs for latching of the drop-in elements in the coupled state of the adaptor piece and the base part.

14. The concrete pump as claimed in claim 1, wherein the part-pipes in the case of a released pipe coupling in the separation point are movable or bendable in relation to one another.

15. The concrete pump as claimed in claim 1, wherein the pipe coupling between the part-pipes is externally accessible by way of a clearance going through the base part.

16. The concrete pump as claimed in claim 1, wherein the outrigger is configured as a collapsible mast and/or a telescopic mast, having at least two boom arms which are interconnected at articulated joints and/or telescopic guides.

* * * * *